United States Patent [19]

Pliley

[11] 4,226,144

[45] Oct. 7, 1980

[54] VISE WITH WATCH COMPONENT ENGAGING JAW ACCESSORIES

[76] Inventor: Larry E. Pliley, 470 S. Colorado Blvd., Suite 209, Denver, Colo. 80222

[21] Appl. No.: 926,402

[22] Filed: Jul. 20, 1978

[51] Int. Cl.[3] ..... G04D 3/00

[52] U.S. Cl. ..... 81/6; 269/283

[58] Field of Search ..... 81/6; 29/807, 177, 427; 269/270, 279–284, 285

[56] References Cited

U.S. PATENT DOCUMENTS

| | | | |
|---|---|---|---|
| 1,344,700 | 6/1920 | Loomis | 81/6 |
| 2,480,415 | 8/1949 | Mettler | 269/285 |
| 2,697,462 | 12/1954 | Connor | 269/268 |
| 2,703,028 | 3/1955 | Goodwill | 269/328 |
| 2,770,156 | 11/1956 | Brettrager | 269/283 |
| 2,876,667 | 3/1959 | Smith | 269/283 |
| 3,322,423 | 5/1967 | Popow et al. | 269/275 |
| 3,768,797 | 10/1973 | Kartasuk et al. | 269/283 |

*Primary Examiner*—Robert C. Watson

*Attorney, Agent, or Firm*—Clarence A. O'Brien; Harvey B. Jacobson

[57] ABSTRACT

A vise is provided to assist in performing various watch repair and maintenance functions and includes a pair of jaws having generally planar and parallel opposing surfaces. The jaws are supported for guided relative movement toward and away from each other along a path disposed substantially normal to the opposing surfaces thereof. The jaws include cylindrical recesses opening outwardly of the opposing surfaces and disposed substantially normal thereto. The opposing jaw surfaces have thin panel members secured thereover constructed of shape retentive, stiff but slightly deformably resilient material and the panel members include circular openings therein substantially coaxial with and of the same diameter as the recesses. A thin circular watch case may be clamped between the jaws with four spaced surface areas of diametrically opposite portions of the watch case engaged by correspondingly spaced portions of marginal portions of the stiff panel members defining the aforementioned circular openings.

2 Claims, 9 Drawing Figures

VISE WITH WATCH COMPONENT ENGAGING JAW ACCESSORIES

BACKGROUND OF THE INVENTION

1. Field of the Invention

Various watch repair and maintenance functions are commonly performed on watches and many of these functions require the use of or may be greatly assisted by the use of a vise. However, watch case portions may be damaged by excessive clamping between rigid clamp jaw faces. Accordingly, a need exists for a vise construction which may be utilized to firmly support watch cases and other watch components without imparting damage thereto. Also, a need exists for a vise construction with which various repair and maintenance function supporting adapters may be conveniently used to assist in the maintenance and repair of watches.

2. Description of the Prior Art

Examples of watch maintenance and repair function vises, tools, and vise adapters including some of the general structural and operational features of the instant invention are disclosed in U.S. Pat. Nos. 1,024,383, 1,344,700, 2,261,055, 2,366,519, 3,209,624, 3,359,839, 3,445,913, and 3,848,484.

BRIEF DESCRIPTION OF THE INVENTION

The vise of the instant invention includes a pair of opposing planar jaw faces relatively movable along a path extending therebetween and normal thereto. The jaw faces are covered with thin panel members secured thereover and constructed of shape retentive, stiff but slightly deformably resilient material and the jaw faces have coaxial cylindrical recesses opening outwardly thereof with which circular openings formed through the panel members are registered and the openings are substantially the same diameter as the recesses. Various maintenance and repair function supportive accessories are provided including support shanks and the support shanks of the accessories are snugly receivable through the openings formed in the thin panel members and in the recesses opening outwardly of the opposing jaw surfaces.

The main object of this invention is to provide a vise construction which may be utilized to tightly support watch components therefrom.

Another object of this invention is to provide a vise construction including attachments therefor adapted to facilitate the installation and removal of watch crystals of the flexible type.

Yet another important object of this invention is to provide a vise jaw attachment for use in initially "breaking" the back of a watch case from the remainder of the case.

A final object of this invention to be specifically enumerated herein is to provide a maintenance and repair function supportive vise for use in conjunction with watches and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
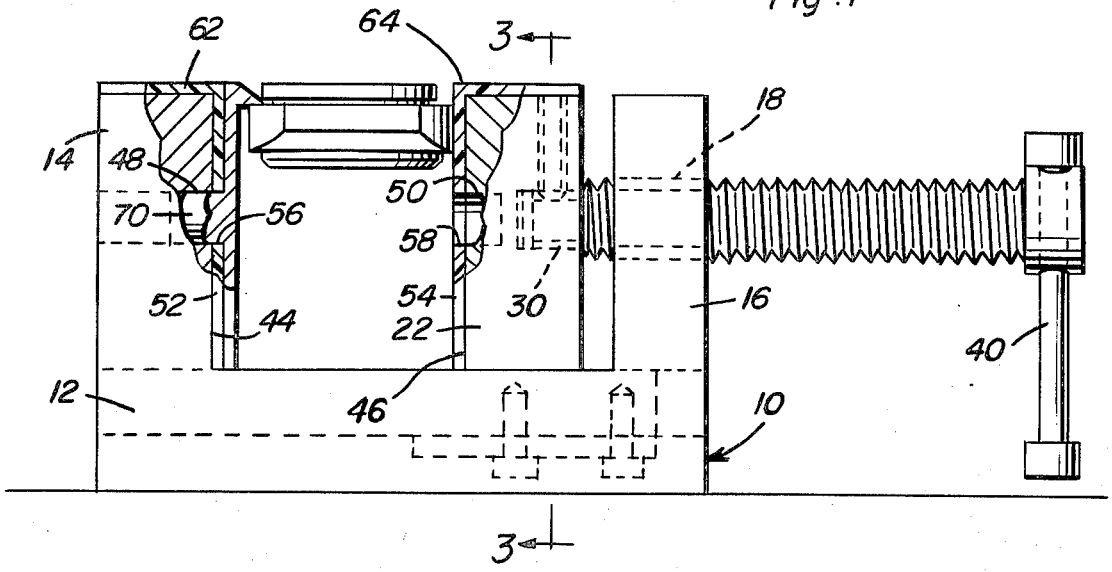
FIG. 1 is a side elevational view of a vise constructed in accordance with the present invention and with a watch back removing attachment supported from one jaw of the vise, portions of the vise and back removing attachment being broken away and illustrated in vertical section.
Figure 2:
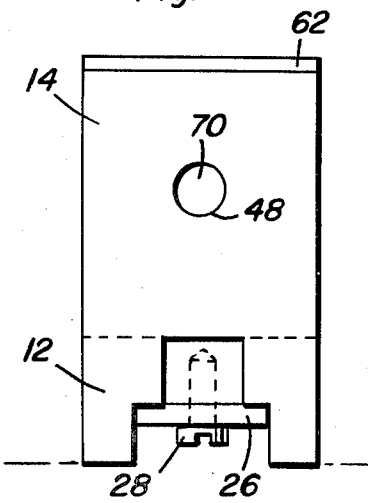
FIG. 2 is an end elevational view of the assemblage of FIG. 1 as seen from the left side thereof.
Figure 3:
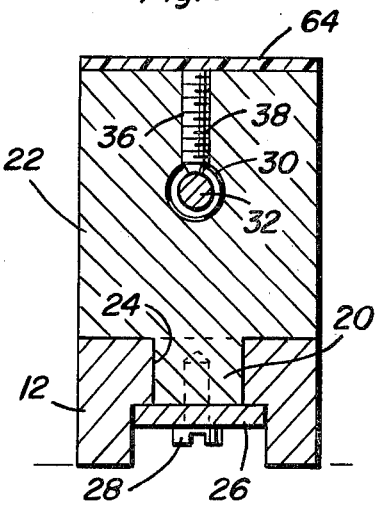
FIG. 3 is a vertical sectional view taken substantially upon the plane indicated by the section line 3—3 of FIG. 1.

Referring now more specifically to the drawings, the numeral 10 generally designates a vise constructed in accordance with the present invention. The vise 10 comprises a commercially available vise including an elongated slotted base 12 from one end of which an upwardly projecting stationary jaw 14 extends. The other end of the base 12 supports an upstanding abutment 16 having a threaded bore 18 formed therethrough and the transversely narrowed lower end portion 20 of an upstanding movable jaw 22 is slidably received in the central longitudinal slot 24 of the base 12 for guided movement along the latter. A plate 26 is secured to the underside of the portion 20 by fasteners 28 in order to secure the portion 20 in position slidably and guidably received within the slot 24.

The jaw 22 includes a blind bore 30 formed in the side thereof opposing the abutment 16 and the bore 30 is coaxial with the bore 18 and has a circumferentially grooved portion 32 of an adjustment screw 34 removably and captively rotatably received therein. The jaw 22 includes a vertical threaded bore 36 opening into the bore 30 and in which a set screw 38 is threadably engaged for retaining the adjusting screw within the bore 30. The screw 34 is threadably received through the bore 18 and includes a slide type diametric handle lever 40 supported from its end remote from the jaw 22.

The above may be considered as descriptive of a conventional form of vise commonly used by persons performing maintenance and repair functions on watches.

The jaws 14 and 22 include opposing planar faces 44 and 46 disposed substantially normal to the path of movement of the jaw 22 toward and away from the jaw 14 and the jaws 14 and 22 include cylindrical recesses 48 and 50 formed therein opening outwardly of the faces 44 and 46. The recesses 48 and 50 are coaxial and the recess 48 comprises a horizontal bore formed completely through the jaw 14 while the recess 50 comprises a blind bore substantially coaxial with the bore 30.

In addition to the jaws 14 and 22 including the recesses 48 and 50, the faces 44 and 46 thereof are covered by planar thin panel members 52 and 54 secured thereover in any convenient manner such as by adhesive and the panel members are constructed of shape retentive, stiff but slightly deformable resilient material. A typical material of which the panel members 52 and 54 may be constructed comprises a high density polyethylene. The panel members 52 and 54 have circular openings 56 and 58 formed therein coaxial with the recesses 48 and 50 and of substantially the same diameter. Accordingly, a thin circular watch case may have diametrically opposite portions thereof seatingly received within the openings 56 and 58 and the jaw 22 may be adjusted toward the jaw 14 whereby to securely clamp the watch case between the jaws, each panel member 52 and 54 engaging the corresponding side of the thin watch case at four spaced points and the stiff but deformably resilient material of which the panel members 52 and 54 are constructed enabling even gold watch cases to be firmly supported between the jaws 14 and 22 without damage to the watch cases.

The panel members 52 and 54 include marginal portions which correspond to and overlie corresponding marginal portions of the jaws 14 and 22 and the upper marginal portions of the panel members 52 and 54 include oppositely directed right angle integral flange portions 62 and 64 which overlie and are adhered to the upper surfaces of the jaws 14 and 22.

Figure 4:
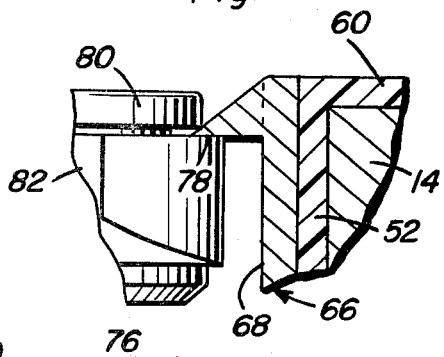
FIG. 4 is a fragmentary, vertical sectional view of the jaw of the vise from which the back removing accessory is supported and with the accessory in position to "break" the back from a watch case.
Figure 5:
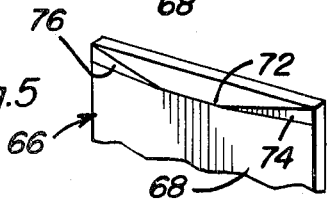
FIG. 5 is a fragmentary, perspective view of the watch case back removing attachment.

With attention now invited more specifically to FIGS. 1, 4 and 5 of the drawing, there may be seen a first form of attachment which may be used in conjunction with the vise 10. The attachment is referred to in general by the reference numeral 66 and comprises a planar panel member 68 constructed of high carbon steel and which conforms in shape to and may overlie the panel member 52 in the manner illustrated in FIG. 1 of the drawing. The central portion of the panel member 68 includes an integral cylindrical shank 70 projecting from its rear side and the shank 70 is snugly receivable through the opening 56 and in the bore 48. Also, the upper marginal portion of the panel member 68 includes a sharpened horizontal wedge-shaped lip 72 extending therealong and projecting from the forward side of the panel 68. The wedge-shaped lip 72 includes oppositely beveled end portions 74 and 76, but the central portion of the lip 72 defines a sharp wedge edge 78 which may be used in the manner illustrated in FIGS. 1 and 4 of the drawing to initially "break" the back 80 from a watch case 82 disposed between the jaws 14 and 22, the watch case 82 actually being clamped between the panel member 54 and the lip 72 of the panel member 68. Also, the lip 72 may be used to remove crystal retainer rings in substantially the same manner and the use of the lip 72 in removing a back or crystal retainer ring avoids damage to watch cases due to handheld wedge tools "slipping".

Figure 6:
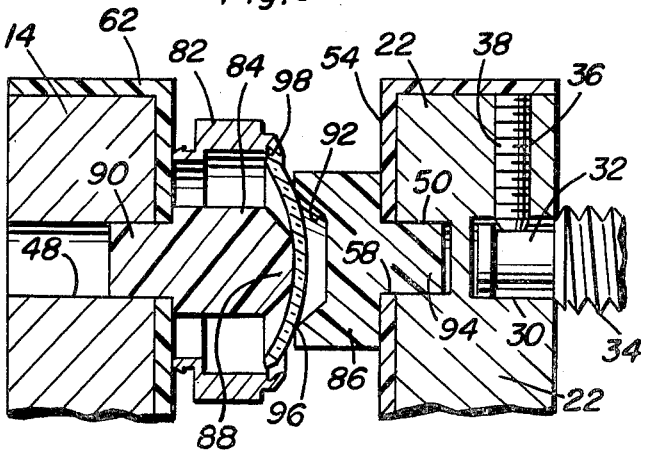
FIG. 6 is a fragmentary, enlarged, longitudinal, vertical sectional view of the vise with a pair of complementary watch crystal insertion and removing adapters supported from the jaws of the vise and in operative association with a convex watch crystal during the process of flexing the crystal for its installation within a watch case.
Figure 8:
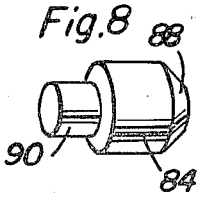
FIG. 8 is a perspective view of the left hand adapter illustrated in FIG. 6.
Figure 9:
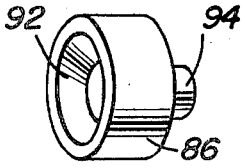
FIG. 9 is a perspective view of the right hand adapter illustrated in FIG. 6.

With attention now invited more specifically to FIGS. 6, 8 and 9 of the drawing, there may be seen a pair of adapters 84 and 86 removably supportable from the jaws 14 and 22. The adapter 84 comprises an elongated male member defining a rounded nose 88 at one end and a cylindrical shank 90 at its other end by which the adapter 84 may be supported from the jaw 14. The shank 90 is receivable in the bore 48 in the same manner as the shank 70 is receivable in the bore 48. The adapter 86 comprises an elongated female member defining endwise outwardly opening recess 92 on one end and a diametrically reduced shank 94 on the other end. The shank 94 is receivable within the recess 50 in the jaw 22 and through the opening 58 formed in the panel member 54. A flexible crystal 96 may be centered relative to and clamped between the adapters 84 and 86 in order to decrease the radius of curvature thereof and, therefore, the over-all diameter of the crystal 96. In such condition, the crystal 96 may be readily inserted into the crystal seat area 98 of the watch case 82 disposed about the adapter 84. Of course, the adapters 84 and 86 may also be utilized to remove the crystal 96 from the case 82.

Figure 7:
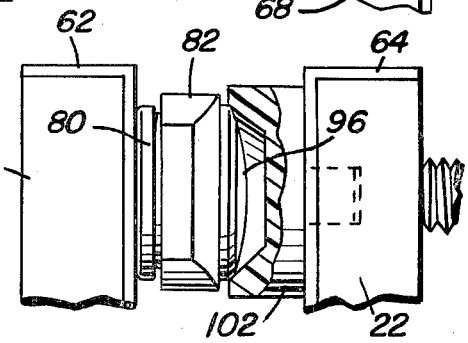
FIG. 7 is a fragmentary, side elevational view illustrating the vise in use with a further adapter to facilitate installation of the back of the watch case to the case without damage to the crystal supported from the case, portions of the adapter being broken away and illustrated in vertical section.

It is further pointed out that the adapters 84 and 86 may be provided in different sizes. For example, an adapter 102 is illustrated in FIG. 7 as supported from the jaw 22 and may be utilized to engage those portions of the watch case 82 disposed outwardly of the crystal 96 after the latter has been installed in order to bias the case 82 toward the jaw 14 in the process of reinstalling the back 80 on the case 82. Also, custom fit, flat and rectangular shaped crystals may be pressed into a watch case opening without damage to the case finish or the plastic crystal. This may be accomplished by holding the watch case vertically between the opposing jaw surfaces and pressing the associated crystal into place while using only the panel members 52 and 54.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A vise for assisting in performing various watch repair and maintenance functions, said vise including a pair of jaws having generally planar and parallel opposing surfaces and supported for guided relative movement toward and away from each other along a path disposed substantially normal to said surfaces, said jaws including coaxial cylindrical recesses formed therein opening outwardly of said surfaces and disposed substantially normal thereto, said surfaces having thin panel members secured thereover constructed of shape retentive, stiff but slightly deformably resilient material, said panel members including circular openings therein substantially coaxial with and the same diameter as said recesses, said openings and recesses being adapted to receive supporting shank portions of jaw accessories therein, a watch case back loosening accessory for one of said jaws, said back loosening accessory including a generally planar panel overlying the corresponding panel member and including an outwardly projecting integral shank portion removably snugly received through and in the corresponding circular opening and cylindrical recess, respectively, said panel including a marginal edge portion thereof along which a rigid outstanding lip extends, said lip projecting outwardly from said panel toward the other jaw and tapering outwardly from said panel to define a sharpened wedge member for wedging between adjacent portions of a watch back and case.

2. A vise for assisting in performing various watch repair and maintenance functions, said vise including a pair of jaws having generally planar and parallel opposing surfaces and supported for guided relative movement toward and away from each other along a path disposed substantially normal to said surfaces, said jaws including coaxial cylindrical recesses formed therein opening outwardly of said surfaces and disposed substantially normal thereto, said surfaces having thin panel members secured thereover constructed of shape retentive, stiff but slightly deformably resilient material, said panel members including circular openings therein substantially coaxial with and the same diameter as said recesses, said openings and recesses being adapted to receive supporting shank portions of jaw accessories therein, a pair of watch crystal installing accessories, said accessories including elongated male and female members having corresponding base and free ends, said base ends including diametrically reduced shank portions snugly removably receivable through said openings and in said recesses, the free end of said male member including a rounded terminal end nose and the free end of said female member defining a shallow outwardly opening recess of generally circular cross-sectional shape and of a larger diameter than the diameter of said rounded terminal end nose.

* * * * *